US011540606B2

(12) United States Patent
Chandler

(10) Patent No.: US 11,540,606 B2
(45) Date of Patent: Jan. 3, 2023

(54) LUGGAGE COVER AND WHEEL WELL ASSEMBLY FOR TRANSPORTING LUGGAGE

(71) Applicant: Carlton W. Chandler, West Palm Beach, FL (US)

(72) Inventor: Carlton W. Chandler, West Palm Beach, FL (US)

( * ) Notice: Subject to any disclaimer, the term of this patent is extended or adjusted under 35 U.S.C. 154(b) by 281 days.

(21) Appl. No.: 16/986,868

(22) Filed: Aug. 6, 2020

(65) Prior Publication Data

US 2021/0037942 A1 Feb. 11, 2021

Related U.S. Application Data

(60) Provisional application No. 62/884,251, filed on Aug. 8, 2019.

(51) Int. Cl.

| | |
|---|---|
| ***A45C 13/00*** | (2006.01) |
| ***A45C 7/00*** | (2006.01) |
| ***A45C 5/03*** | (2006.01) |

(52) U.S. Cl.

CPC ..... *A45C 13/002* (2013.01); *A45C 7/0018* (2013.01); *A45C 5/03* (2013.01)

(58) Field of Classification Search

CPC ..... A45C 13/002; A45C 7/0018; A45C 5/03

See application file for complete search history.

(56) References Cited

U.S. PATENT DOCUMENTS

| | | | | |
|---|---|---|---|---|
| 5,016,772 | A * | 5/1991 | Wilk | B65D 21/086 220/495.11 |
| 6,637,562 | B2 | 10/2003 | Oh | |
| 7,093,699 | B2 | 8/2006 | Yu | |
| D557,899 | S | 12/2007 | Chang | |
| D705,541 | S | 5/2014 | Harris | |
| D712,662 | S | 9/2014 | Lai | |
| 10,159,322 | B2 | 12/2018 | Yu | |
| 2005/0109775 | A1* | 5/2005 | Meissen | B65D 21/0212 220/23.6 |
| 2018/0132584 | A1* | 5/2018 | Boyles | B63B 32/80 |
| 2020/0069014 | A1* | 3/2020 | Scott | A45C 13/30 |

* cited by examiner

*Primary Examiner* — Tri M Mai

(74) *Attorney, Agent, or Firm* — FisherBroyles, LLP; Rachel H. Huffstetler

(57) ABSTRACT

A luggage cover and wheel well assembly for transporting luggage. The luggage cover includes a generally rigid base and wheel well assembly positioned within the protective base. The wheel well assembly includes a base support and a pair of expandable members. The expandable members cooperate with the base support to move between a retracted position to an expanded position to secure luggage of various sizes within the luggage cover.

18 Claims, 8 Drawing Sheets

LUGGAGE COVER AND WHEEL WELL ASSEMBLY FOR TRANSPORTING LUGGAGE

CROSS REFERENCE TO RELATED APPLICATIONS

This application claims priority to U.S. Pat. App. No. 62/488,251, filed Aug. 8, 2019, the disclosure of which is hereby incorporated by reference.

FIELD OF THE INVENTION

The present invention is directed to a protective cover and a wheel well assembly for protecting luggage, such as a suitcase and, more specifically, a protective cover to safeguard the luggage for transport, such as for shipping or airline transport.

BACKGROUND OF THE INVENTION

Shipping luggage has become an attractive option for travelers, either for convenience, necessity or economic reasons. As more and more airlines charge travelers to check a first or second bag on flights, and charge even more for bags over certain weight limits, luggage shipping is an attractive alternative. This is particularly true considering that even when a passenger pays a bag fee, excess bag fee, or an overweight bag fee, the airlines make no guarantees that the bag will make it to your destination, on time, or in good condition. And, of course, the baggage security policies are also to be considered. Airlines no longer permit locked suitcases (at least, not ones that cannot be opened with a master key for inspection). Incidences of lost, mishandled, or damaged luggage are well-known. From a convenience standpoint, a passenger traveling without luggage does not have to wait in line to check the bags before the initial flight and does not wait again at the baggage carousel at the destination. Nor must the traveler have to physically transport luggage to and from the airport.

Hence, shipping luggage has become a viable alternative. One solution is to purchase a corrugated suitcase box formed of cardboard to enclose a suitcase for shipping. These boxes are, generally, not reusable, must be purchased each time, and do not offer sufficient protection to the suitcase during shipping. Moreover, cardboard is not weather resistant, durable, or uniquely designed to protect the wheels, particularly, of the suitcase. Another solution is to place the luggage in a plastic tote. A rectangular standard size tote also is not uniquely designed to conform to the luggage and the luggage or suitcase is free to move within the container. No protection is provided for the easily damaged wheels of the suitcase as it moves freely within the container which may experience turbulence during transport.

SUMMARY OF THE INVENTION

The present invention overcomes shortcomings of the prior art by providing a protective enclosure or cover which protects the luggage housed therein, provides easy handling during transport, and is reusable and cost-efficient. This is achieved with a protective luggage cover which is uniquely configured to accommodate and fit an item of luggage, such as a suitcase. This is also achieved by providing a wheel well assembly to protect the wheels of a suitcase. The wheel well assembly is adjustable to further facilitate a custom, form fitting enclosure for the luggage/suitcase.

DETAILED DESCRIPTION OF THE INVENTION

The present invention will now be described in detail hereinafter by reference to the accompanying drawings. The invention is not intended to be limited to the embodiments described; rather, this detailed description is provided to enable any person skilled in the art to make and practice the invention.

As used herein, the singular forms "a," "an" and "the" include plural referents unless the context clearly dictates otherwise. Thus, for example, reference to a "tether" includes aspects having two or more tethers unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not. For the purposes of describing and defining the present invention it is noted that the use of relative terms, such as "substantially", "generally", "approximately", and the like, are utilized herein to represent an inherent degree of uncertainty that is attributed to any quantitative comparison, value, measurement, or other representation. These terms are also utilized herein to represent the degree by which a quantitative representation may vary from a stated reference without resulting in a change in the basic function of the subject matter at issue.

The luggage cover 10 is sized and configured to accommodate conventional sized luggage such as suitcases. Like a suitcase, if has height measured longitudinally which is greater than its width, measured horizontally. It has a depth, measured front to back, to accommodate the depth of a suitcase, for example. The luggage cover is provided in varying sizes, such as the following (Height×Width×Depth): 27×17×12⅝; 48×16×12⅝; 33×20×12⅝; 25½×15⅛×12⅝; and 24×24×12⅝ to accommodate smaller carryon size suitcases, medium sized suitcases, and larger suitcases. Of course, these are provided by way of example only, as it is within the scope of the present invention that the luggage cover 10 may be sized and configured to accommodate any size or shape of luggage.

Figure 1:
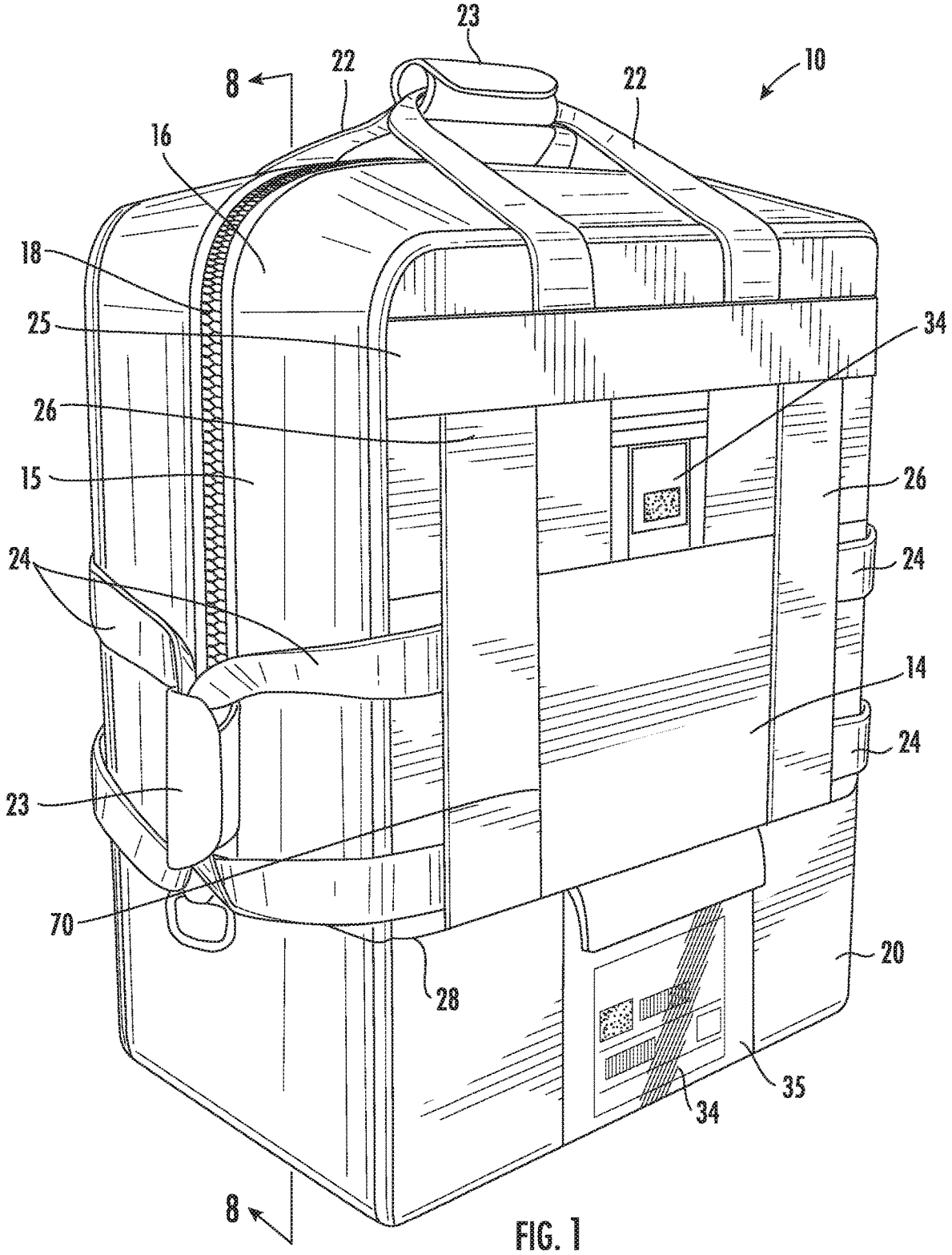
FIG. 1 is a perspective view of the luggage cover enclosing a suitcase according to the present invention.
Figure 2:
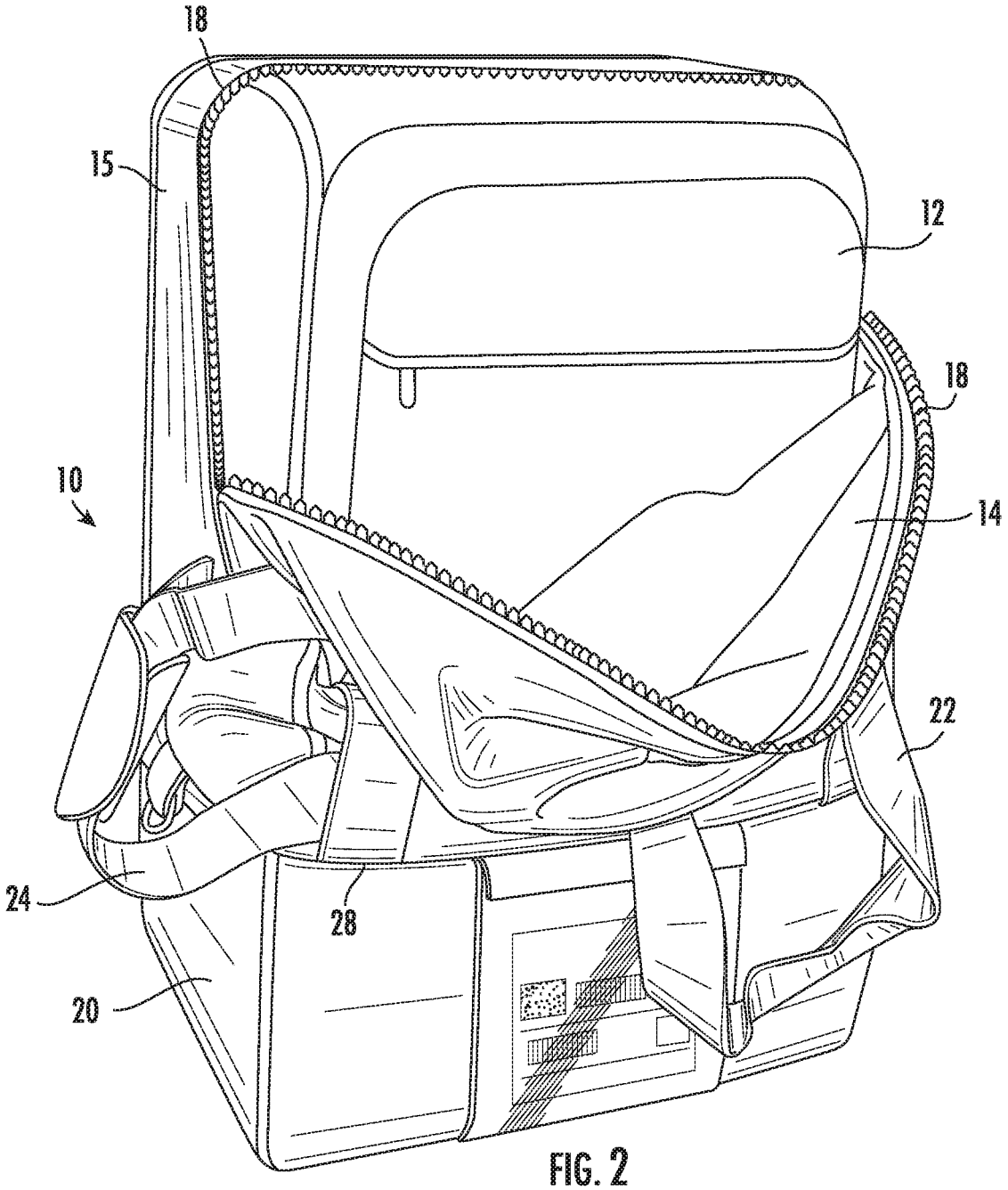
FIG. 2 is a perspective view of the luggage cover of FIG. 1 with the cover partially opened.
Figure 3:
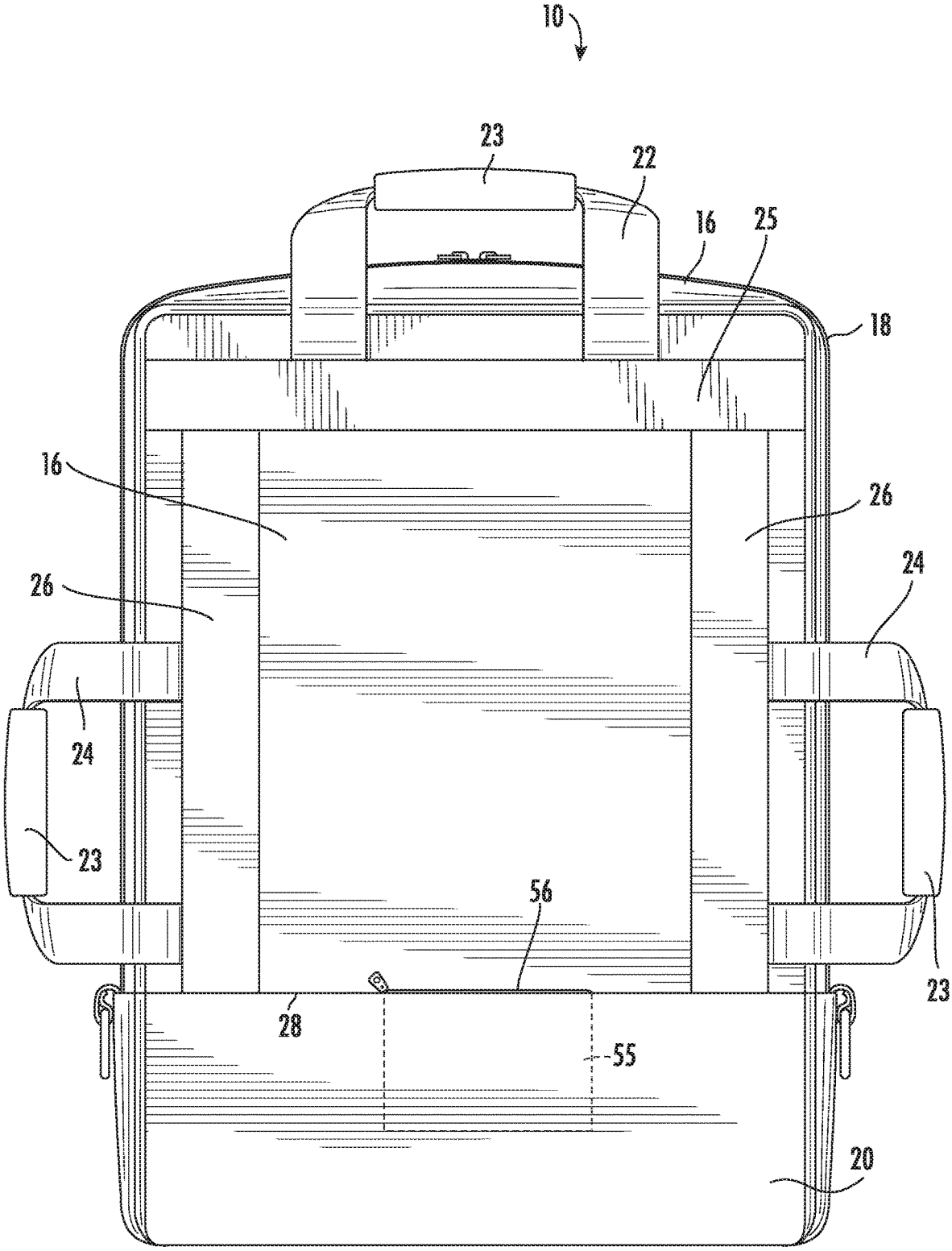
FIG. 3 is a perspective view of the rear side of the luggage cover of FIG. 1.

FIGS. 1-3 illustrate the luggage cover 10 which houses a suitcase 12. As shown in FIG. 1, the luggage cover 10 includes a front panel 14 and a rear panel 16, each of which define side panels 17 so as to provide a luggage receiving cavity. Side panels 17 therefore define right, left, and top panels. A closure, such as zipper 18, extends along the first 15 and second side panels 16 to open and close the luggage cover 10. It is within the scope of the present invention, however, to provide other closure members such as VELCRO®, ties, or the like. The luggage cover 10 is formed of a weather-resistant and durable material such as a woven canvas fabric made of cotton and/or polyvinyl chloride with or without treatment for extra durability and protection. An exemplary product is that sold under the brand name CORDURA®. The luggage cover 10 includes a protective base 20 configured to receive the bottom of the suitcase 12, as explained in more detail below. The zipper 18, as shown extends from the cover protective base 20 and along the side panels 15, 16 so as to define a wide opening for easy insertion and removal of the suitcase 12.

The luggage cover 10 includes handles for facilitating easy manipulation. As shown, upper handles 22 facilitate lifting and/or moving the luggage cover 10 in an upright position as shown in FIGS. 1-3. The upper handles 22 each extend from the front panel 14 or the rear panel 16. A pair of side handles 24 are also shown and facilitate lifting and/or moving the luggage cover 10 in a horizontal position. Side handles 24 extend from the front 14 or rear panel 16, respectively. A handle grip 23 is shown on each handle and may optionally be used.

A reinforcement system in the form of reinforcing members are secured to the front 14 and rear panels 16 to provide additional structural integrity to the luggage cover 10. As shown in FIGS. 1 and 3, the front panel 14 and rear panel 16 include at least one horizontally extending reinforcing member 25 and a pair of spaced apart perpendicular, longitudinally extending reinforcing members 26. The positions of reinforcing members 25, 26 are shown by way of example as more or less of either may be provided and may extend in any direction. The reinforcing members 25, 26 may be formed of any strong material, rigid or flexible. As shown, a strong, flexible, woven fabric is provided, such as high-strength material woven of nylon, polyester, and/or polypropylene.

Figure 4:
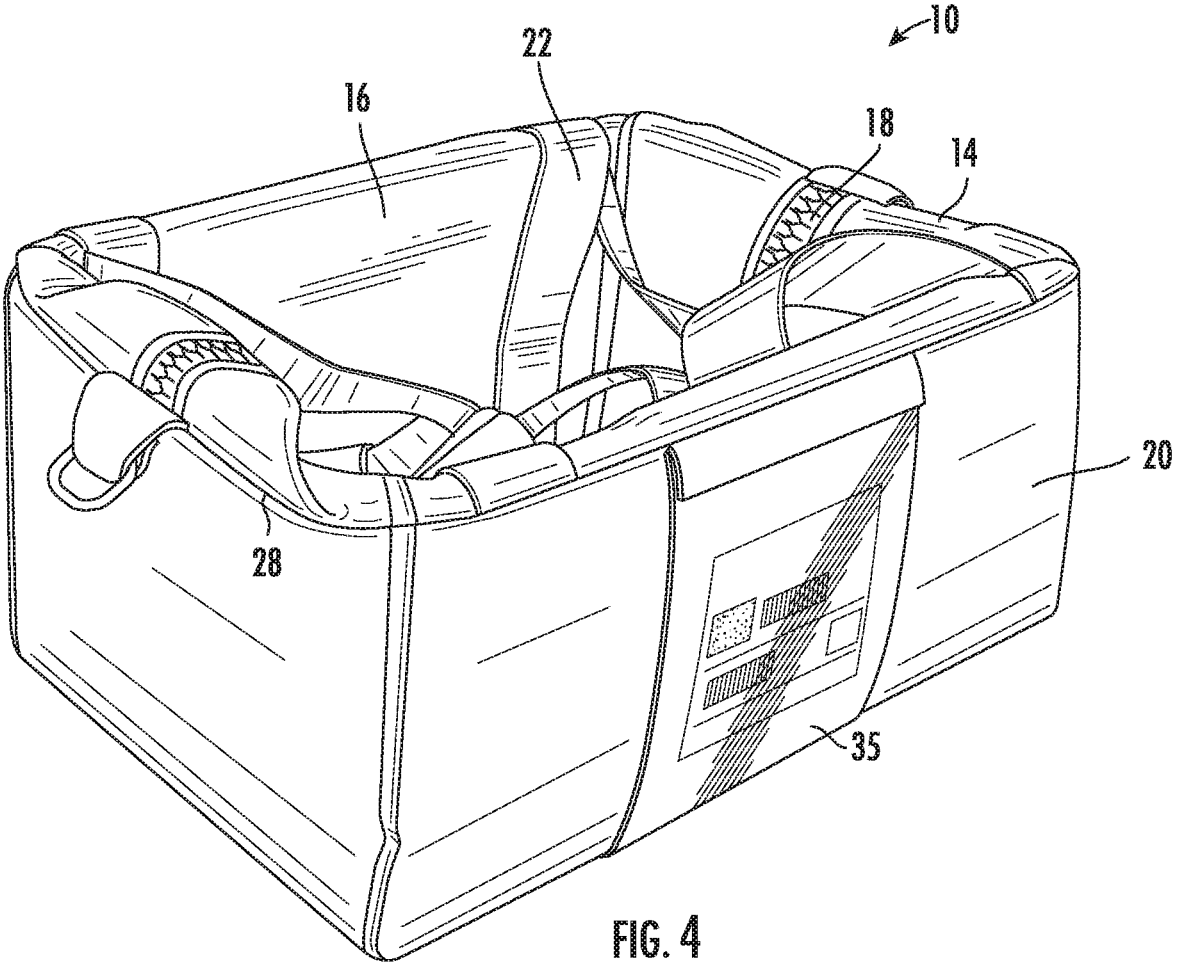
FIG. 4 is a perspective view of the luggage cover of FIG. 1 with the cover fully open and devoid of luggage.
Figure 5:
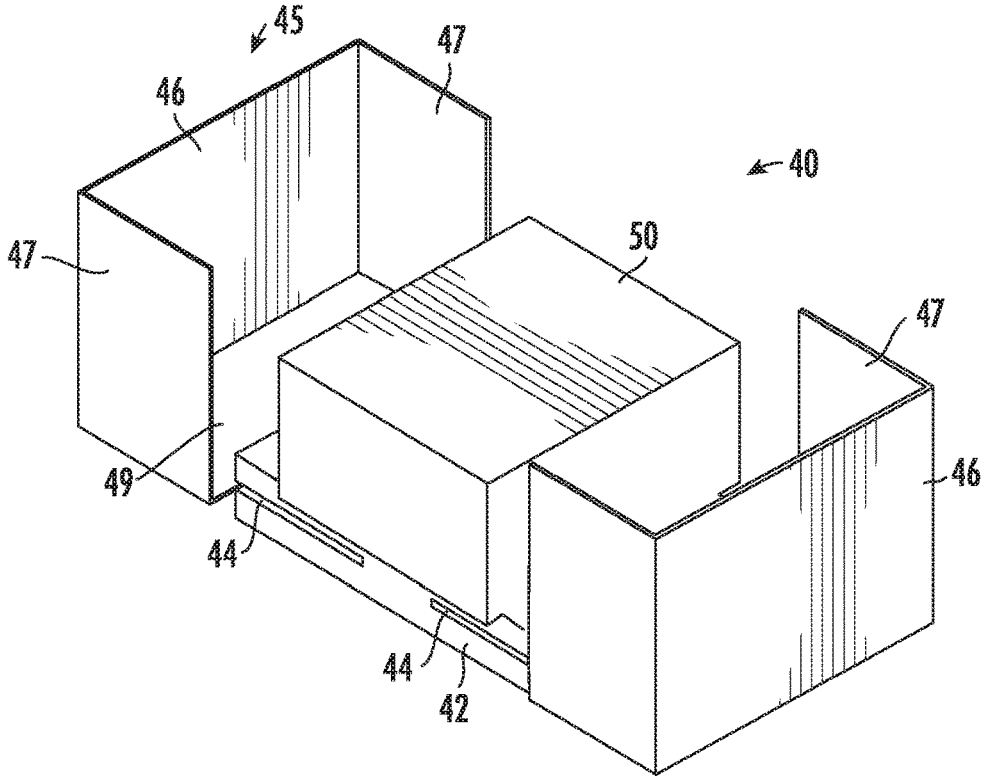
FIG. 5 is a perspective view of the wheel well assembly according to the present invention in a disengaged, expanded position.
Figure 6:
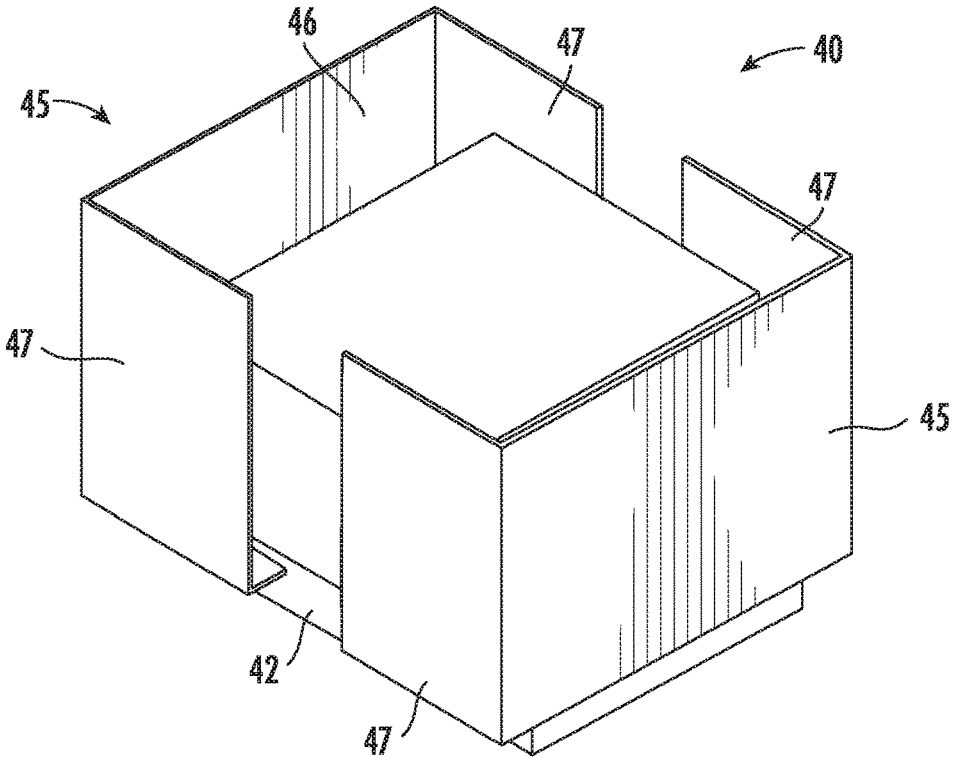
FIG. 6 is a perspective view of the wheel well assembly according to FIG. 5 in an engaged, contracted position.
Figure 8:
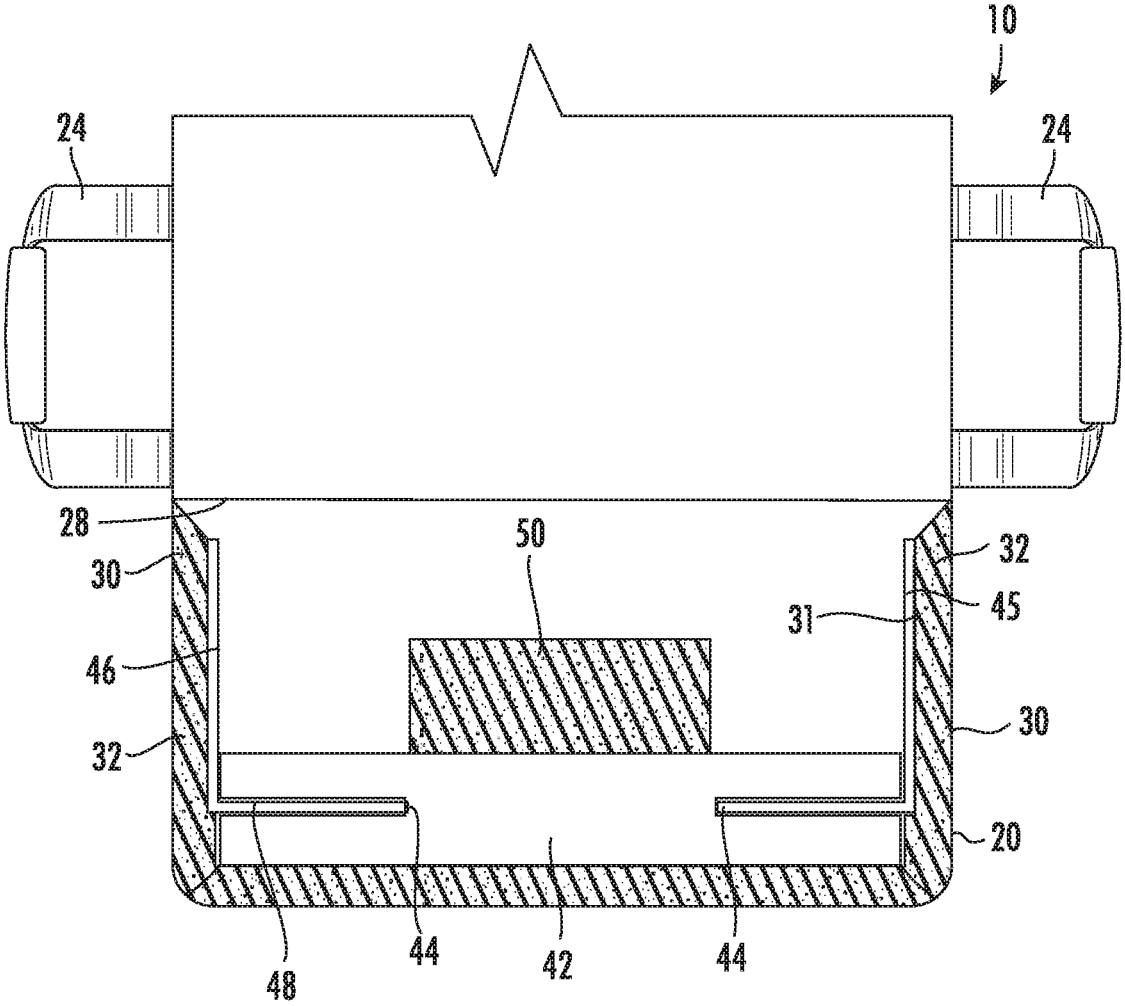
FIG. 8 is a cross sectional view of the luggage cover and wheel well assembly taken along line 8-8 in FIG. 1.

The protective base 20 of the luggage cover 10, as shown, is formed as the same material as the front 14 and rear panels 15 with a seam 28 differentiating the protective base. This is by way of example, as the protective base 20 may be omitted. As shown in FIG. 4, the protective base 20 is substantially rigid wherein the front 14 and rear panels 16 collapsed into the protective base 20 when devoid of luggage. As shown in FIG. 8, the protective base includes an outer layer 30 and an inner layer 31. A material having a predetermined amount of rigidity, such as foam 32, is positioned between the layers. Other materials may also be selected, such as a more rigid and/or hard material.

The front 14 and rear panels 16 provide areas for shipping labels. As shown by way of example, an upper label area in the form of a clear pocket 34 is positioned on the front panel 14. Another pocket 35 is positioned on the protective base 20. These are shown on the front panel 14 but may also be on the rear panel 16 or side panels 17. A pocket, such as pocket 55 shown in FIG. 3, is also selectively provided. Pocket 35 is shown on the rear side of the bag and is shown in phantom as it extends within the liner of the cover 10, between the outer rear panel 16 and the foam 32. A pocket opening 56 is positioned adjacent the seam 28 and defines the opening to the pocket 55. As shown, a zipper is provided at the opening 56. Of course, the pocket may not contain any closure or other closures known in the art. These pockets 34, 35, and 55 may be provided in any number and/or combination and in any location.

Figure 7:
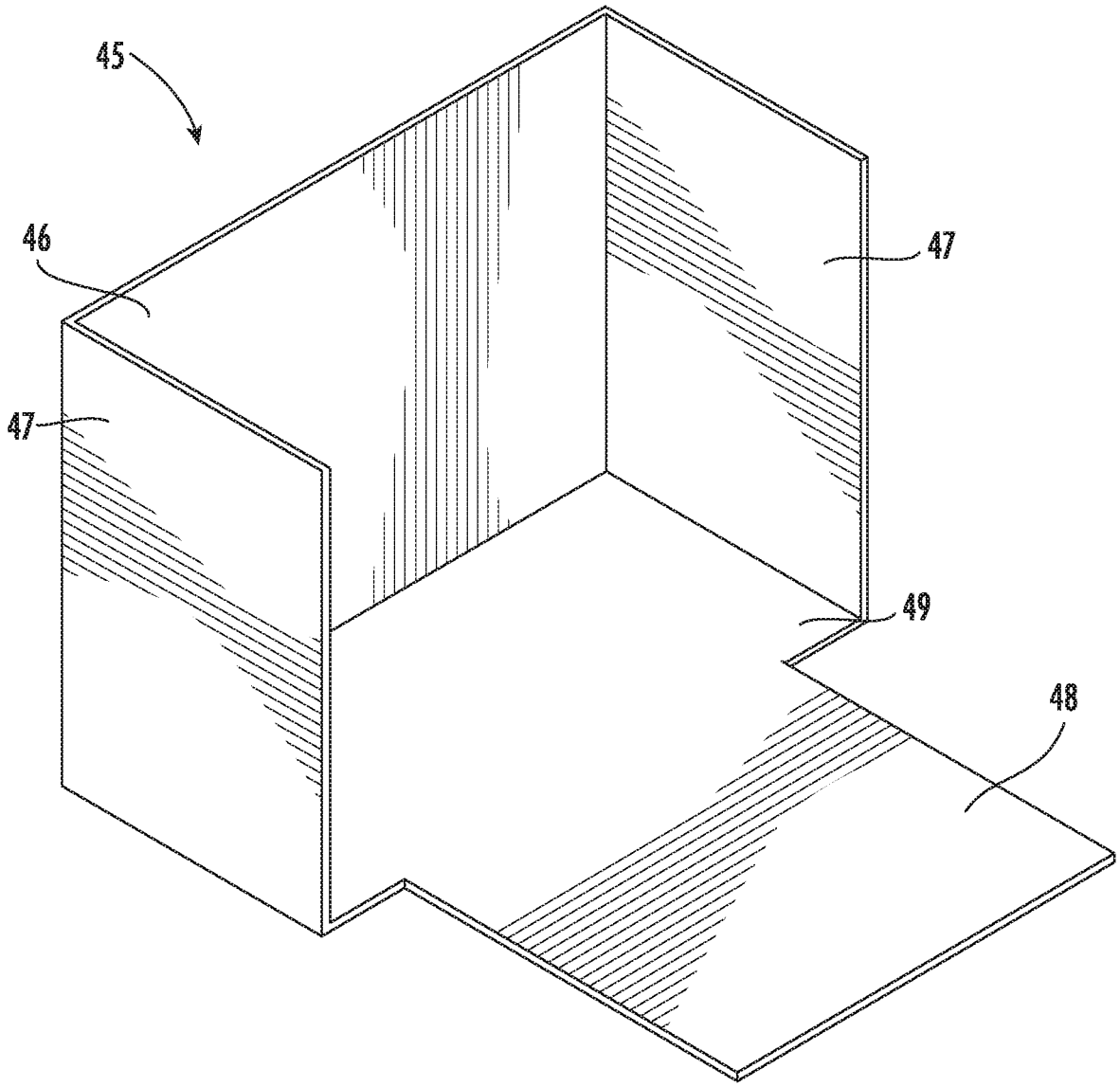
FIG. 7 is a perspective view of the expandable member of the wheel well assembly of FIG. 5.

A wheel well assembly 40 is provided and is sized and configured to cooperate with the luggage cover 10 to further protect the suitcase 12 positioned therein. As shown in FIGS. 5-9, the wheel well assembly 14 includes a base support 42 which defines channels 44 on opposing sides. The wheel well assembly 40 also includes a pair of expandable members 45. Each expandable members 45 includes a side wall 46, front and rear walls 47 and a bottom wall 49 forming a generally rectangular receptacle for receiving the suitcase 12. A perpendicularly extending mating segment 48 for mating with the channels 44 of the base support 42 extends. As shown in FIG. 7, the mating segment 48 of the expandable member 45 has a width less than the width between opposing front and rear walls 47. The channels 44 are configured with appropriate variances to enable the mating segments 48 of the expandable members 45 to slideably engage and disengage therewith.

Figure 9:
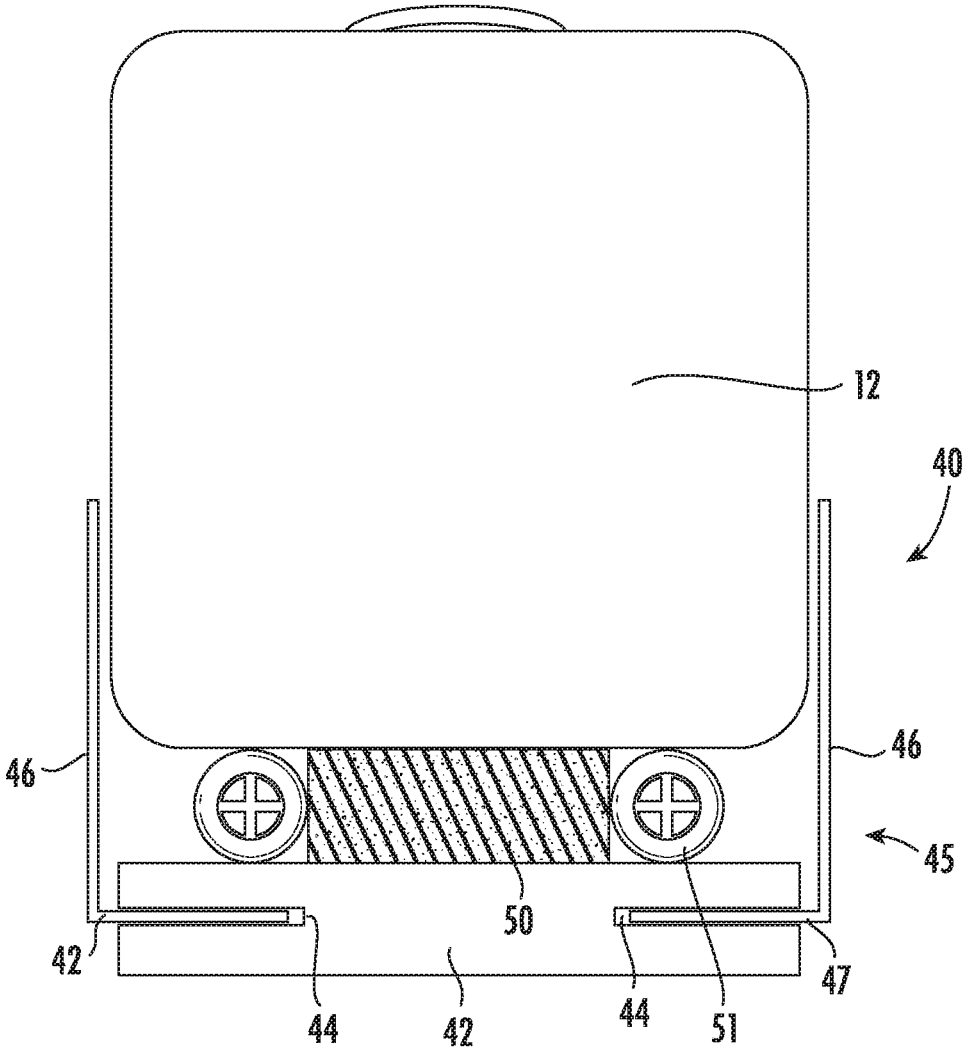
FIG. 9 is a cross sectional view of the luggage cover and wheel well assembly of FIG. 6 (1 shown without a suitcase housed therein).

FIG. 9 depicts a suitcase 12 positioned within the wheel well assembly 40. The suitcase sits on the base support 42 and, if the suitcase has wheels 51, a block support 50, such as one formed of foam, is positioned between the suitcase 12 wheels on the base support 42. This prevents sliding of the wheels. The expandable members 45 are then urged inward to conform to the suitcase width as the mating segments 48 move within the channels 44.

In use, the user may select the appropriate luggage cover 10 closest in size and configuration for the luggage or suitcase to be transported (shipped or checked in with an airline, for example) and provide the desired information in the various pockets 34, 35 at any step of the process. The luggage cover 10 is then place upright and the front 14 and rear 16 side panels are folded down. The wheel well assembly 40 is then inserted into the protective base 20 and the width adjusted accordingly. The foam block 50 is optionally positioned on the base support 42. The suitcase 12 is then inserted into the luggage cover 10 and the wheel base is positioned on the base support 42 of the wheel well assembly 40. The expandable members may then be adjusted. The front 14 and rear 16 panels are then pulled upward and over the suitcase 12, and the zipper 18 may be closed.

While exemplary embodiments have been shown and described above for the purpose of disclosure, modifications to the disclosed embodiments may occur to those skilled in the art. The disclosure, therefore, is not limited to the above precise embodiments and that changes may be made without departing from its spirit and scope.

What is claimed is:

1. A protective luggage cover for an article of luggage comprising:

a front panel having a top and bottom segment, a rear panel having a top and bottom segment, a bottom panel and two side panels connected to said front, rear and bottom panels wherein said top segments of said front and rear panels have a predetermined amount of rigidity and wherein said front, bottom, rear and side panels define a luggage receiving cavity;

a luggage cavity opening for permitting access to said luggage receiving cavity;

a protective base defined by said front panel bottom segment and said rear panel bottom segment, said protective base having a predetermined amount of rigidity greater than said front panel top segment and said rear panel top segment rigidity;

a wheel well assembly positioned within said protective base comprising a base support positioned on said bottom panel within said luggage cavity and at least one expandable member which is selectively moveable from a first retracted position to a second expanded position to provide an adjustable width to said wheel well assembly, said expandable member comprising a side wall and a bottom wall extending generally perpendicular to said side wall and being operatively connected to said base support wherein said expandable member moves from said first to said second positions.

2. The protective luggage cover according to claim 1 wherein said bottom support defines a horizontal channel having an aperture facing said luggage cover side panel and configured for receipt of said expandable member bottom wall in said first and second positions.

3. The protective luggage cover according to claim 2 wherein said horizontal channel has a length and said expandable member bottom wall has a length wherein said horizontal channel length is at least as long as said bottom wall length.

4. The protective luggage cover according to claim 2 wherein said expandable member further comprises front and rear walls generally perpendicular to said expandable member side wall and said bottom wall is perpendicular to said front and rear walls for forming a generally rectangular receptacle configured for receipt of the luggage.

5. The protective luggage cover according to claim 2 wherein said wheel well assembly comprises a second of said at least one expandable member wherein each of said expandable members are expandable and said base support defines at least two of said channels configured for receipt of said bottom wall of each of said expandable member bottom walls.

6. The protective luggage cover according to claim 2 wherein said at least one expandable member bottom wall includes a mating member extending from said bottom wall for mating with said horizontal channel, said mating member having a first width and wherein said bottom wall has a second width and said mating member first width is less than said bottom wall second width.

7. The protective luggage cover according to claim 1 further comprising a block support positioned on said wheel well assembly base support.

8. The protective luggage cover according to claim 1 wherein said front and rear panels each include reinforcing members defined by at least one horizontal and at least one vertical member for adding additional strength to said front and rear panels.

9. The protective luggage cover according to claim 1 wherein said luggage cavity opening comprises a closure to selectively open and close said luggage receiving cavity and configured for egress and ingress of said luggage.

10. The protective luggage cover according to claim 1 wherein said protective base comprises an inner layer, and outer layer, and substantially rigid middle layer.

11. The protective luggage cover according to claim 10 wherein said luggage cover front panel including said protective base outer layer are formed of the same material.

12. The protective cover according to claim 1 further comprising a pocket on said front panel.

13. The protective luggage cover according to claim 1 wherein said side panels each have a top and bottom segment and said protective base further comprises said side panel bottom segments wherein said side panel bottom segments have a rigidity greater than a rigidity of said side panel top segments.

14. A wheel well assembly for use in a luggage cover comprising:

a base support; and at least one expandable member which is selectively moveable from a first retracted position to a second expanded position to provide an adjustable width to said wheel well assembly, said at least one expandable member comprising a side wall and a bottom wall extending generally perpendicular to said side wall and being operatively connected to said base support wherein said expandable member moves from said first to said second positions and wherein said base support defines a horizontal channel having an aperture facing said at least one expandable member side wall and configured for receipt of said expandable member bottom wall in said first and second positions and wherein said horizontal channel has a length and said expandable member bottom wall has a length wherein said horizontal channel length is at least as long as said bottom wall length.

15. The protective luggage cover according to claim 14 wherein said expandable member further comprises front and rear walls generally perpendicular to said expandable member side wall and said bottom wall is perpendicular to said front and rear walls for forming a generally rectangular receptacle configured for receipt of the luggage.

16. The protective luggage cover according to claim 14 wherein said wheel well assembly comprises a second of said at least one expandable member wherein each of said expandable members are expandable and said base support defines at least two of said channels configured for receipt of said bottom wall of each of said expandable member bottom walls.

17. The protective luggage cover according to claim 14 wherein said at least one expandable member bottom wall includes a mating member extending from said bottom wall for mating with said horizontal channel, said mating member having a first width and wherein said bottom wall has a second width and said mating member first width is less than said bottom wall second width.

18. The protective luggage cover according to claim 14 further comprising a block support positioned on said wheel well assembly base support.

* * * * *